US006824843B2

(12) United States Patent
Inoue et al.

(10) Patent No.: US 6,824,843 B2
(45) Date of Patent: Nov. 30, 2004

(54) INK JET RECORDING MEDIUM AND METHOD FOR ITS PRODUCTION

(75) Inventors: Masahiro Inoue, Yokohama (JP); Hirokazu Wakabayashi, Tokyo (JP)

(73) Assignee: Asahi Glass Company, Limited, Tokyo (JP)

( * ) Notice: Subject to any disclaimer, the term of this patent is extended or adjusted under 35 U.S.C. 154(b) by 179 days.

(21) Appl. No.: 10/170,444

(22) Filed: Jun. 14, 2002

(65) Prior Publication Data

US 2003/0049420 A1 Mar. 13, 2003

(30) Foreign Application Priority Data

Jun. 15, 2001 (JP) ..... 2001-181867

(51) Int. Cl.[7] ..... B41M 5/40

(52) U.S. Cl. ..... 428/32.25; 428/32.17; 428/32.31; 428/32.35; 428/32.36; 427/245

(58) Field of Search ..... 428/32.25, 32.31, 428/32.17, 32.35, 32.36; 427/245

(56) References Cited

U.S. PATENT DOCUMENTS

| | | | | | |
|---|---|---|---|---|---|
| 5,750,200 | A | * | 5/1998 | Ogawa et al. | 427/361 |
| 6,436,513 | B1 | * | 8/2002 | Kitamura et al. | 428/195 |
| 6,457,825 | B1 | * | 10/2002 | Bermel et al. | 347/105 |
| 6,465,086 | B1 | * | 10/2002 | Kitamura et al. | 428/212 |
| 6,576,324 | B2 | * | 6/2003 | Yoshino et al. | 428/195.1 |
| 2002/0028320 | A1 | * | 3/2002 | Iwasa et al. | 428/195 |

* cited by examiner

*Primary Examiner*—B. Shewaraged
(74) *Attorney, Agent, or Firm*—Oblon, Spivak, McClelland, Maier & Neustadt, P.C.

(57) ABSTRACT

An ink jet recording medium comprising a water-impermeable substrate, a first porous layer formed on the substrate, and a second porous layer formed on the first porous layer, wherein the psychometric lightness (L*) at a black solid printed portion with a black dye ink is at most 5.0.

11 Claims, No Drawings

INK JET RECORDING MEDIUM AND METHOD FOR ITS PRODUCTION

The present invention relates to a high quality recording medium employing a water-impermeable substrate, excellent in color reproducibility and sharpness, and particularly having a low psychometric lightness at a black printed portion, and a method for its production.

As a recording medium to be used for ink jet recording, an ink jet recording medium having various properties such as fixing property of an ink for ink jet recording, absorptivity, print density, roundness of dots, sharpness around dots, gloss, whiteness, water resistance and light resistance is developed. However, for such an ink jet recording medium, particularly for one for a photo grade, an ink jet recording medium having a high gloss, gloss and smoothness close to those of a photograph, a high print density, and excellent fixing property and absorptivity of an ink for ink jet recording, as properties of its recording surface, has been required.

However, in a case where a first porous layer is formed on a water-impermeable substrate and a second porous layer is further formed thereon, if the amount of a solvent in a coating liquid for formation of the second porous layer is in excess of the absorption of the first porous layer, no uniform surface would be formed due to bubbles from the porous layer. Further, if the amount of a solvent in a coating liquid for formation of the second porous layer is excessively smaller than the absorption of the first porous layer, the solid content concentration in the coating liquid for formation of the second porous layer rapidly increases due to water absorbing power of the first porous layer, whereby no smooth coated surface or no uniform coated surface can be formed.

Under these circumstances, it is an object of the present invention to provide a high quality ink jet recording medium having controlled surface of the second porous layer, having a high gloss, gloss and smoothness close to those of a photograph, a high print density, a high fixing property and high absorptivity of an ink for ink jet recording, and particularly excellent in color reproducibility and sharpness, and a method for producing it.

According to a first aspect of the present invention, there is provided an ink jet recording medium comprising a water-impermeable substrate, a first porous layer formed on the substrate, and a second porous layer formed on the first porous layer, wherein the psychometric lightness (L*) at a black solid printed portion with a black dye ink is at most 5.0.

According to a second aspect of the present invention, there is provided a method for producing an ink jet recording medium, which comprises coating a first porous layer containing inorganic fine particles and a binder, formed on a water-impermeable substrate, with a coating liquid containing inorganic fine particles and a binder to form a second porous layer, wherein the solid content concentration C (mass %) in the coating liquid for formation of the second porous layer satisfies the following Formulae 1 and 2:

$$C \geqq 20D/(D+X/5) \quad \text{Formula 1}$$

$$C \leqq 500D/(D+5X) \quad \text{Formula 2}$$

wherein X ($g/m^2$) is the total water absorption of the first porous layer and D ($g/M^2$) is the coating amount of the second porous layer after drying. The total water absorption of the first porous layer is obtained in such a manner that the area of the medium having the first porous layer formed on the water-impermeable substrate is defined, the medium is immersed in water for 60 seconds, and the mass of the medium before the immersion is subtracted from the mass after the immersion.

Of the ink jet recording medium of the present invention, the psychometric lightness (L*) at a black printed portion by solid printing with a black dye ink (hereinafter referred to simply as black printed portion) is at most 5.0, whereby the ink jet recording medium has excellent color reproducibility and sharpness at a black printed portion. L* measured at a black printed portion is preferably at most 3.0, particularly preferably at most 2.0. The psychometric lightness (L*) at a black printed portion of the ink jet recording medium of the present invention is evaluated by psychometric lightness in L*a*b* color system of JIS-Z8729 as measured by a method of JIS-Z8722 measured at a black printed portion (hereinafter referred to as L*).

In the second aspect of the present invention, it is required to adjust C in accordance with conditions of X and D at the time of forming the second porous layer on the first porous layer formed on the water-impermeable substrate, so as to obtain a recording medium having a high gloss. If C is out of the range of Formula 1, the amount of the solvent in the coating liquid for formation of the second porous layer tends to be large. Accordingly, after formation of the second porous layer, the air in the first porous layer can not adequately come out, thus causing bubbly defects on the surface of the second porous layer. If C is out of the range of Formula 2, when the first porous layer is coated with the coating liquid for formation of the second porous layer, the solvent in the coating liquid is rapidly absorbed in the first porous layer, whereby the surface of the second porous layer tends to be non-uniform. Further, the leveling property on the surface of the second porous layer tends to decrease, whereby no adequate smoothness of the surface of the second porous layer tends to be obtained. Namely, if C is out of at least one of the ranges of Formula 1 and Formula 2, smoothness of the surface of the second porous layer tends to be poor, whereby the amount of irregularly reflected light on the surface tends to increase, thus decreasing color reproducibility and sharpness at a black printed portion.

Accordingly, an ink jet recording medium formed by using the coating liquid for formation of the second porous layer, the solid content concentration of which satisfies both Formulae 1 and 2, has a high surface smoothness of the second porous layer even after a drying step. Accordingly, the amount of irregularly reflected light on the surface of the second porous layer tends to be small, reproducibility and sharpness of an image tend to be excellent, and excellent reproducibility and sharpness of an image particularly at a black printed portion can be obtained.

Now, the present invention will be described in detail with reference to the preferred embodiments.

The ink jet recording medium according to the first aspect of the present invention has such a construction that at least one ink-receiving layer (hereinafter referred to as a first porous layer) is provided on at least one side of a substrate, and another ink-receiving layer (hereinafter referred to as a second porous layer) is laminated thereon.

The substrate to be used in the present invention is required to be a water-impermeable substrate. The water-impermeable substrate may, for example, be a highly smooth polyester film of e.g. polyethylene terephthalate or polyethylene naphthalate, a synthetic paper obtained by biaxial orientation of a polyolefin, or a resin coated paper (RC paper) having a polyolefin resin coated layer.

For the ink jet recording medium of the present invention, it is required to provide at least one first porous layer between the water-impermeable substrate and the second porous layer, so as to achieve an ink jet recording medium which adequately absorbs an ink and which has more excellent ink jet recording properties. The first porous layer preferably contains a binder resin and inorganic pigment fine particles. Further, it may contain an additive such as a water resistance imparting agent, a light resistance imparting agent, a weather resistance imparting agent or a hardening agent.

The inorganic pigment fine particles contained in the first porous layer may be inorganic pigment fine particles which are insoluble or hardly soluble in water. Specifically, preferred are a synthetic amorphous silica, a xerogel obtained by removing a solvent from a silica sol, a xerogel obtained by removing a solvent from a silica sol having its surface cation-denatured, an alumina hydrate such as alumina or boehmite, magnesium silicate, magnesium carbonate and silica/alumina composite particles. Among them, preferred is an alumina hydrate such as boehmite which is excellent in e.g. ink absorptivity and transparency. The average particle size of the alumina hydrate such as boehmite is preferably from 100 to 500 nm, whereby a porous layer excellent in ink absorptivity, transparency and smoothness can be formed. As the alumina hydrate such as boehmite contained in the first porous layer, a xerogel obtained by removing a solvent from an alumina sol as disclosed in JP-A-10-231120 may, for example, be mentioned.

The first porous layer of the present invention preferably contains a binder resin. The binder resin may, for example, be a polyvinyl alcohol, polyvinyl acetate, oxidized starch, casein, gelatin, a denatured polyvinyl alcohol such as carboxy-denatured polyvinyl alcohol, a cellulose derivative such as carboxymethyl cellulose or hydroxymethyl cellulose, a polymer of acrylate or methacrylate, or an acryl type polymer latex, and they may be used alone or as a blended polymer. The first porous layer may contain a crosslinking agent for a binder such as boric acid or borax.

The first porous layer is formed preferably by mixing the above materials forming the layer to prepare a coating liquid. The weight ratio of the binder resin and the inorganic pigment fine particles is preferably such that (binder resin):(inorganic pigment fine particles)=3:100 to 20:100, whereby ink absorptivity and dye fixing property tend to be excellent. It is particularly preferably from 4:100 to 15:100. An additive such as a water resistance imparting agent, a light resistance imparting agent or a weather resistance imparting agent may be incorporated into the coating liquid.

The first porous layer of the present invention is formed preferably by coating the substrate with the coating liquid, followed by drying to form at least one porous layer. The coating amount can suitably be set, but is preferably from 1 to 100 g/m$^2$. If it is less than 1 g/m$^2$, no adequate ink may be absorbed, and if it exceeds 100 g/m$^2$, strength of the first porous layer tends to decrease. It is particularly preferably from 30 to 50 g/m$^2$.

As a means for forming the first porous layer on the substrate, a roll coater, an air knife coater, a blade coater, a rod coater, a bar coater, a comma coater, a die coater, a gravure coater, a slide hopper or a curtain coater may, for example, be mentioned.

In the ink jet recording medium of the present invention, the second porous layer is formed on the first porous layer so as to obtain a surface having a high gloss. The second porous layer contains a binder resin and inorganic pigment fine particles. Further, it may contain an additive such as a water resistance imparting agent, a light resistance imparting agent or a weather resistance imparting agent.

The inorganic pigment fine particles contained in the second porous layer are preferably ones having an average particle size of from 30 to 300 nm so as to impart gloss on the surface of the ink jet recording surface. Within this range, an ink jet recording medium having high smoothness and transparency of the second porous layer and excellent in color reproducibility and sharpness can be obtained. If the average particles size is smaller than 30 nm, the ink absorptivity tends to be poor, and if it exceeds 300 nm, the transparency tends to decrease, and the color reproducibility and sharpness tend to be poor. It is particularly preferably from 80 to 200 nm.

The second porous layer preferably contains at least one type of inorganic pigment fine particles which are insoluble or hardly soluble in water. They may, for example, be a synthetic amorphous silica, a xerogel obtained from a silica sol, a xerogel obtained from a silica sol having its surface cation-denatured, an alumina hydride such as alumina or boehmite, magnesium silicate, magnesium carbonate or silica/alumina composite particles. Among them, preferred are silica/alumina composite particles having favorable dye fixing property and color reproducibility and excellent in scratch resistance. As the silica/alumina composite particles to be used for the second porous layer, silica/alumina composite particles as disclosed in WO99/64354 may, for example, be mentioned.

As the binder resin to be contained in the second porous layer, the same binder resin as one in the first porous layer may be used. Further, a crosslinking agent for a binder such as boric acid or borax may suitably be added.

The second porous layer is formed by mixing the inorganic pigment fine particles and the binder to prepare a coating liquid, and coating the substrate with the coating liquid, followed by drying. The weight ratio of the binder resin to the inorganic pigment fine particles is preferably such that (binder resin):(inorganic pigment fine particles)=3:100 to 20:100, whereby ink absorptivity, dye fixing property and adhesion to the substrate tend to be excellent. It is particularly preferably from 4:100 to 15:100.

The coating amount of the second porous layer is preferably from 0.5 to 20 g/m$^2$. If the coating amount is smaller than 0.5 g/m$^2$, no adequate gloss surface can be obtained, and if it exceeds 20 g/m$^2$, absorptivity of an ink for ink jet recording tends to be poor. It is particularly preferably from 0.5 to 10 g/m$^2$, more preferably from 0.5 to 3.0 g/m$^2$.

As a means of coating the coating liquid for formation of the second porous layer, a roll coater, an air knife coater, a blade coater, a rod coater, a bar coater, a comma coater, a die coater, a gravure coater, a slide hopper or a curtain coater may, for example, be mentioned.

The ink jet recording medium according to the first aspect of the present invention is preferably achieved by the method according to the second aspect of the present invention.

Now, the present invention will be explained in further detail with reference to Examples. However, it should be understood that the present invention is by no means restricted to such specific Examples.

First, a silica/alumina composite sol was synthesized in the same method as in WO99/64354. Further, an alumina sol was synthesized in the same method as in JP-A-10-231120.

Synthesis of Silica/Alumina Composite Sol for Second Porous Layer 248 g of a silica sol having spherical silica primary particles having an average particle size of the primary particles of 27 nm dispersed therein ($SiO_2$ concentration: 48.4 mass %, $Na_2O$ concentration: 0.41 mass %, CATALOID SI-50, tradename, manufactured by CATALYSTS & CHEMICALS IND. CO., LTD.) and 1,688 g of deionized water were put in a glass reactor having a capacity of 2 l, and the temperature was raised to 80° C. When the temperature became 80° C., 63.7 g of an aqueous polyaluminum chloride solution (aluminum concentration as calculated as $Al_2O_3$: 23.5 mass %, Cl concentration: 8.1 mass %, basicity: 84%, TAKIBINE #1500, tradename, manufactured by Taki Chemical Co., Ltd.) was gradually added thereto over a period of about 10 minutes with stirring.

After completion of the addition, stirring was carried out for 1 hour while keeping the temperature at 80° C. Then, an aqueous sodium hydroxide solution was added to the reaction solution to adjust pH of the reaction solution to 7.3 (80° C.), and the reaction solution was cooled, then the reaction solution was subjected to ultrafiltration by means of an ultrafiltration apparatus for purification until the conductance of the filtrate decreased to not higher than 50 $\mu$S/cm while keeping the amount of the solution constant by adding deionized water.

Then, as a deflocculating agent, amidosulfuric acid was added thereto in such an amount that it became 3% of the total solid content of the purified solution, and the solution was subjected to vacuum concentration under heating until the total solid content concentration became 20%, and finally the solution was subjected to ultrasonic dispersion to obtain a silica/alumina composite sol having an average particle size of agglomerated particles of 147 nm and a pH of 5.7.

Synthesis of Alumina Sol for First Porous Layer 327 g of an aqueous polyaluminum chloride solution (aluminum concentration as calculated as $Al_2O_3$: 23.5 mass %, Cl concentration: 8.1 mass %, basicity, 84%, TAKIBINE #1500, tradename, manufactured by Taki Chemical Co., Ltd.) and 1,548 g of water were introduced into a glass reactor having a capacity of 2 l, and the temperature was raised to 95° C. Then, 125 g of a commercially available sodium aluminate solution ($Al_2O_3$: 20 mass %, $Na_2O$: 19 mass %) was added thereto, and the solution was kept at 95° C. with stirring for 24 hours for aging to obtain a slurry. The pH of the solution immediately after the addition of the sodium aluminate solution was 8.7 at 95° C.

The slurry after aging was washed by means of an ultrafiltration apparatus, then the temperature was raised to 95° C. again, amidosulfuric acid was added thereto in such an amount that it became 3% of the total solid content of the slurry after washing, the slurry was subjected to vacuum concentration until the total solid content concentration became 25%, and finally the slurry was subjected to ultrasonic dispersion to obtain an alumina sol having an average particle size of agglomerated particles of 190 nm and a pH of 3.8.

EXAMPLE 1

The alumina sol for first porous layer and a polyvinyl alcohol (MA-26GP, manufactured by Shin-Etsu Chemical Co., Ltd.) were mixed in a solid content ratio of 100:10, and water was added thereto for adjustment so that the solid content concentration would be 19%. A polyester film having a thickness of 125 $\mu$m (U51LY, manufactured by Teijin DuPont) was uniformly coated with the above liquid so that the weight after drying would be 37 g/m$^2$ to obtain an ink jet recording medium having a first porous layer. The water absorption X (g/m$^2$) of the first porous layer was 23.7 g/m$^2$.

The silica/alumina composite sol for second porous layer and a polyvinyl alcohol (MA-26GP, manufactured by Shin-Etsu Chemical Co., Ltd.) were mixed in a solid content ratio of 100:8, and water was added thereto so that the solid content concentration would be 9% to prepare a coating liquid for formation of second porous layer. The first porous layer was coated with the above coating liquid so that D would be 2.7 g/m$^2$ to obtain an ink jet recording medium.

EXAMPLES 2 to 7

An ink jet recording medium was obtained in the same manner as in Example 1 except that the coating amount of the first porous layer, X and D were as identified in Table 1, and the solid content concentration of the coating liquid for formation of second porous layer was adjusted depending upon these conditions.

Comparative Examples 1 to 3

A recording medium was obtained in the same manner as in Example 1 except that the coating amount of the first porous layer, X, C and D were as identified in Table 1.

Measurement of Color Density

On the porous layer surface of each of the ink jet recording media obtained in Examples 1 to 7 and Comparative Examples 1 to 3, 100% solid printings with dyes of black, cyan, magenta and yellow were separately carried out by means of PM-800C (manufactured by SEIKO EPSON CORPORATION) in a gloss film mode. The color densities at the respective printed portions were measured by means of a reflection densitometer (SPECTROLINO SPM-100 II, tradename, manufactured by Gretag). The results are shown in Table 2.

Measurement of Psychometric Lightness (L*)

On the second porous layer of each of the ink jet recording media obtained in Examples 1 to 7 and Comparative Examples 1 to 3, 100% solid printing with a black dye ink was carried out. The psychometric lightness (L*) at the printed portion was measured by means of a densitometer (SPM-100II, tradename, manufactured by Gretag). The results are shown in Table 2.

Measurement of 60° Gloss

The 60° gloss at a non-printed portion of each of the ink jet recording media obtained in Examples 1 to 7 and Comparative Examples 1 to 3 was measured by means of a glossmeter PG-1M (manufactured by Nippon Denshoku). The results are shown in Table 2.

EXAMPLE 8

With respect to the recording medium obtained in Example 2, the color density, psychometric lightness (L*) and 60° gloss were measured in the same manner as in the above evaluation methods except that printing was carried out by using PM-800C (manufactured by SEIKO EPSON CORPORATION) as a printer in a normal paper mode. The results are shown in Table 3.

EXAMPLE 9

Measurements were carried out in the same manner as in Example 8 except that printing was carried out by means of PM-900C (manufactured by SEIKO EPSON CORPORATION) as a printer in a special purpose gloss film mode. The results are shown in Table 3.

EXAMPLE 10

Measurements were carried out in the same manner as in Example 8 except that printing was carried out by means of PM-900C (manufactured by SEIKO EPSON CORPORATION) as a printer in a normal paper mode. The results are shown in Table 3.

EXAMPLE 11

Measurements were carried out in the same manner as in Example 8 except that printing was carried out by means of PM-770C (manufactured by SEIKO EPSON CORPORATION) as a printer in a gloss film mode. The results are shown in Table 3.

EXAMPLE 12

Measurements were carried out in the same manner as in Example 8 except that printing was carried out by means of PM-770C (manufactured by SEIKO EPSON CORPORATION) as a printer in a normal paper mode. The results are shown in Table 3.

TABLE 1

| | Coating amount of first porous layer ($gm^{-2}$) | Water absorption of first porous layer X ($gm^{-2}$) | Coating amount of second porous layer D ($gm^{-2}$) | $C_{min}$ (%) | Solid content concentration of coating liquid for formation of second porous layer C (%) | $C_{max}$ (%) |
|---|---|---|---|---|---|---|
| Example 1 | 37 | 23.7 | 2.7 | 7.26 | 9.0 | 11.15 |
| Example 2 | 37 | 23.7 | 2.7 | 7.26 | 10.0 | 11.15 |
| Example 3 | 40 | 25.6 | 3.0 | 7.39 | 8.0 | 11.45 |
| Example 4 | 40 | 25.6 | 3.0 | 7.39 | 10.0 | 11.45 |
| Example 5 | 35 | 22.4 | 2.7 | 7.52 | 8.0 | 11.77 |
| Example 6 | 35 | 22.4 | 3.0 | 8.02 | 11.0 | 13.04 |
| Example 7 | 35 | 22.4 | 3.0 | 8.02 | 9.0 | 13.04 |
| Comparative Example 1 | 35 | 22.4 | 2.7 | 7.52 | 7.0 | 11.77 |
| Comparative Example 2 | 35 | 22.4 | 3.0 | 8.02 | 8.0 | 13.04 |
| Comparative Example 3 | 35 | 22.4 | 2.7 | 7.52 | 13.0 | 11.77 |

In Table 1, $C_{min}$ and $C_{max}$ represent lower limit and upper limit of the solid content concentration of the coating liquid for second porous layer in accordance with the coating conditions in Examples 1 to 7 and Comparative Examples 1 to 3, respectively. $C_{min}$ and $C_{max}$ are values obtained by applying values of D and X into Formula 1 and Formula 2, respectively. The 60° gloss, the color density at the printed portion and L* at the black printed portion of the media prepared as mentioned above are shown in Table 2.

TABLE 2

| | Color density at printed portion | | | | Black printed portion | 60° gloss at non-printed |
|---|---|---|---|---|---|---|
| | Black | Cyan | Magenta | Yellow | (L*) | portion |
| Example 1 | 2.66 | 2.81 | 2.03 | 1.16 | 1.85 | 56.67 |
| Example 2 | 2.66 | 2.80 | 2.03 | 1.17 | 1.98 | 54.83 |
| Example 3 | 2.60 | 2.77 | 2.05 | 1.19 | 2.58 | 55.43 |
| Example 4 | 2.58 | 2.75 | 2.05 | 1.18 | 2.77 | 50.87 |
| Example 5 | 2.55 | 2.69 | 1.99 | 1.21 | 3.41 | 56.30 |
| Example 6 | 2.50 | 2.67 | 1.98 | 1.22 | 3.55 | 50.67 |
| Example 7 | 2.40 | 2.63 | 1.98 | 1.20 | 4.14 | 55.97 |
| Comparative Example 1 | 1.95 | 2.04 | 1.77 | 1.17 | 10.26 | 30.37 |
| Comparative Example 2 | 2.11 | 2.22 | 1.80 | 1.18 | 7.72 | 46.67 |

TABLE 2-continued

| | Color density at printed portion | | | | Black printed portion | 60° gloss at non-printed |
|---|---|---|---|---|---|---|
| | Black | Cyan | Magenta | Yellow | (L*) | portion |
| Comparative Example 3 | 2.36 | 2.40 | 1.83 | 1.18 | 5.62 | 47.53 |

As evident from the results shown in Table 2, the media of Examples 1 to 7 have a high gloss and a high color density. L* at the black printed portion of these media is at most 5.0, and these media are excellent in color reproducibility and sharpness.

Among them, the media of Examples 1 to 4 have L* at the black printed portion of at most 3.0, and are particularly excellent in color reproducibility and sharpness at the black printed portion. Further, the media of Examples 1 and 2 have L* at the black printed portion of at most 2.0, and are very excellent in color reproducibility and sharpness at the black printed portion.

On the other hand, on the recording media of Comparative Examples 1 to 3, L* at the black printed portion exceeds 5.0, whiteness tends to be strong, and color densities not only at the black printed portion but also at the other color printed portions decreased, and the media of Comparative Examples 1 to 3 are poor in color reproducibility and sharpness.

TABLE 3

| | Color density at printed portion | | | | Black printed portion | 60° gloss at non-printed |
|---|---|---|---|---|---|---|
| | Black | Cyan | Magenta | Yellow | (L*) | portion |
| Example 8 | 2.37 | 2.35 | 1.53 | 1.11 | 3.59 | 53.5 |
| Example 9 | 2.46 | 2.69 | 1.83 | 1.36 | 2.95 | 53.5 |
| Example 10 | 2.46 | 2.31 | 1.47 | 1.08 | 3.10 | 53.3 |
| Example 11 | 2.50 | 2.60 | 1.91 | 1.41 | 2.96 | 53.2 |
| Example 12 | 2.48 | 2.58 | 1.92 | 1.42 | 3.07 | 53.1 |

As evident from Table 3, the ink jet recording media of the present invention have L* at the black printed portion so low as at most 5. The ink jet recording media of the present invention have suppressed L*, whereby the color density at the ink jet printed portion with each dye is high.

According to the present invention, a high quality ink jet recording medium having a high gloss on the surface and a high color density, excellent in color reproducibility and a high color sharpness, and particularly having a low L* at a black printed portion, can be obtained.

The entire disclosure of Japanese Patent Application No. 2001-181867 filed on Jun. 15, 2001 including specification, claims and summary are incorporated herein by reference in its entirety.

What is claimed is:

1. An ink jet recording medium comprising a water-impermeable substrate, a first porous layer formed on the substrate, and a second porous layer formed on the first porous layer, wherein the psychometric lightness (L*) at a black solid printed portion with a black dye ink is at most 5.0, wherein the ink jet recording medium is obtained by a method which comprises coating a first porous layer containing inorganic fine particles and a binder, formed on a water-impermeable substrate, with a coating liquid containing inorganic fine particles and a binder to form a second porous layer, wherein the solid content concentration C (mass %) in the coating liquid for formation of the second porous layer satisfies the following Formulae 1 and 2:

$$C \geqq 20D/(D+X/5) \quad \text{Formula 1}$$

$$C \leqq 500D/(D+5X) \quad \text{Formula 2}$$

wherein X ($g/m^2$) is the total water absorption of the first porous layer and D ($g/m^2$) is the coating amount of the second porous layer after drying.

2. The ink jet recording medium according to claim 1, wherein the second porous layer contains silica/alumina composite particles having an average particle size of from 30 to 300 nm and a binder.

3. The ink jet recording medium according to claim 1, wherein the psychometric lightness (L*) at a black solid printed portion with a black dye ink is at most 3.0.

4. The ink jet recording medium according to claim 1, wherein the substrate is a polyester film.

5. The ink jet recording medium according to claim 1, wherein the substrate is a synthetic paper obtained by biaxial orientation of a polyolefin.

6. The ink jet recording medium according to claim 1, wherein the substrate is a resin coated paper having a polyolefin resin coated layer.

7. A method for producing an ink jet recording medium, which comprises coating a first porous layer containing inorganic fine particles and a binder, formed on a water-impermeable substrate, with a coating liquid containing inorganic fine particles and a binder to form a second porous layer, wherein the solid content concentration C (mass %) in the coating liquid for formation of the second porous layer satisfies the following Formulae 1 and 2:

$$C \geqq 20D/(D+X/5) \quad \text{Formula 1}$$

$$C \leqq 500D/(D+5X) \quad \text{Formula 2}$$

wherein X ($g/m^2$) is the total water absorption of the first porous layer and D ($g/m^2$) is the coating amount of the second porous layer after drying.

8. The method for producing an ink jet recording medium according to claim 7, wherein the coating liquid for formation of the second porous layer contains silica/alumina composite particles having an average particle size of from 30 to 300 nm and a binder.

9. The method for producing an ink jet recording medium according to claim 7, wherein the substrate is a polyester film.

10. The method for producing an ink jet recording medium according to claim 7, wherein the substrate is a synthetic paper obtained by biaxial orientation of a polyolefin.

11. The method for producing an ink jet recording medium according to claim 7, wherein the substrate is a resin coated paper having a polyolefin resin coated layer.

* * * * *